US009352349B2

(12) United States Patent
Mikesell, Sr. et al.

(10) Patent No.: US 9,352,349 B2
(45) Date of Patent: May 31, 2016

(54) PAINTING PROTECTOR

(71) Applicants: Andrew Mikesell, Sr., Indianapolis, IN (US); Michele Mikesell, Indianapolis, IN (US)

(72) Inventors: Andrew Mikesell, Sr., Indianapolis, IN (US); Michele Mikesell, Indianapolis, IN (US)

( * ) Notice: Subject to any disclaimer, the term of this patent is extended or adjusted under 35 U.S.C. 154(b) by 391 days.

(21) Appl. No.: 14/170,554

(22) Filed: Jan. 31, 2014

(65) Prior Publication Data

US 2014/0216335 A1 Aug. 7, 2014

Related U.S. Application Data

(60) Provisional application No. 61/759,651, filed on Feb. 1, 2013.

(51) Int. Cl.
*B05C 1/00* (2006.01)
*B05C 21/00* (2006.01)
*B05B 15/04* (2006.01)

(52) U.S. Cl.
CPC ..... *B05B 15/0475* (2013.01); *B05C 21/005* (2013.01)

(58) Field of Classification Search
None
See application file for complete search history.

(56) References Cited

U.S. PATENT DOCUMENTS 3,565,038 A 2/1971 Barringer
4,276,852 A 7/1981 Adams
4,787,331 A * 11/1988 Jarvis ..... B05B 15/0487 118/504
4,950,842 A * 8/1990 Menninga ..... H02G 3/14 174/67
5,285,014 A * 2/1994 Gilchrist ..... B05B 15/045 118/505
5,723,816 A * 3/1998 Neece ..... H02G 3/14 174/66
5,853,811 A 12/1998 Poague
6,103,974 A * 8/2000 Erdfarb ..... B05B 15/045 174/66
6,166,329 A * 12/2000 Oliver ..... H02G 3/14 174/58
6,664,471 B1 * 12/2003 Howe, Jr. ..... H02G 3/14 174/66
6,686,540 B2 * 2/2004 Compagnone, Jr. ... H02G 3/126 174/58
6,703,562 B1 * 3/2004 Pacheco ..... H02G 3/14 174/66
6,927,341 B1 * 8/2005 Crane ..... H02G 3/14 16/DIG. 2
7,071,413 B1 * 7/2006 Paape ..... H02G 1/00 174/66
7,105,057 B1 * 9/2006 Colussi ..... B05B 15/0481 118/504
7,186,917 B1 * 3/2007 Van De Wiele, Jr. .... H02G 3/14 174/66
8,835,763 B1 * 9/2014 Hammond ..... H02G 3/12 174/66
2007/0029177 A1 * 2/2007 Sprague ..... H02G 3/12 200/19.38
2007/0187127 A1 * 8/2007 Compagnone ..... H02G 3/14 174/58
2008/0047731 A1 * 2/2008 Krueger ..... H02G 3/12 174/67
2008/0245546 A1 * 10/2008 Sutter ..... H02G 1/00 174/66
2009/0272558 A1 * 11/2009 Compagnone, Jr. ..... H02G 3/14 174/58
2013/0112456 A1 * 5/2013 Nedrich ..... H02G 3/14 174/66
2014/0069333 A1 * 3/2014 Van't Hof ..... B05C 21/005 118/505
2015/0249327 A1 * 9/2015 Nedrich ..... H02G 3/14 174/67

* cited by examiner

*Primary Examiner* — Dah-Wei D Yuan
*Assistant Examiner* — Jethro M Pence
(74) *Attorney, Agent, or Firm* — Woodard, Emhardt, Moriarty, McNett & Henry LLP

(57) ABSTRACT

A painting protector which can be easily held with one hand and placed snugly against an area in which paint is not to be applied, such an outlet or switch. The other hand can then be used to apply paint to the areas around the painting protector which are desired to have paint applied. The painting protector can then be removed and the painter can proceed to the next location upon which paint is to be applied.

7 Claims, 3 Drawing Sheets

PAINTING PROTECTOR

CROSS-REFERENCE TO RELATED APPLICATIONS

The benefit of U.S. Provisional Patent Application No. 61/759,651 (filed Feb. 1, 2013) is claimed, and that provisional application is hereby incorporated by reference.

FIELD OF THE DISCLOSURE

The present disclosure relates to a painting protector to be used by painters as a means to increase the speed in which they are able to complete a painting assignment by eliminating an element of the preparation work which is normally used. More specifically, the present disclosure relates to a painting protector that can be held in place with one hand over an area that is not supposed to receive any paint (such as switches, outlets and other openings) while the other hand can be used to apply paint around the area covered by the protector.

Typically, in order to complete a "professional" looking painting job, the painter would seek to ensure that the paint was only put on those areas in which paint was meant to be applied. Historically, in order to address this issue a painter would painstakingly remove all switch covers, outlet covers, data covers, hanging light outlet covers, etc. They would then use "painter's tape" to tape over the switches, power outlets, data outlets, hanging lights, etc. However, this task is very time-consuming as well as expensive (once the worker's time plus the tape and other materials) is considered. The present invention introduces a painting protector which can be held temporarily in place over switches, power outlets, data outlets and the like, to protect them from inadvertent paint being applied to them. While the protector is being held in place, paint can be applied to the area around the protector and, once completed, the protector can be removed and placed upon the next switch, power outlet, etc.

DESCRIPTION

For the purpose of promoting an understanding of the principles of the present invention, reference will now be made to the embodiment illustrated in specific language contained herein. It will, nevertheless, be understood that no limitation of the scope of the invention is thereby intended; any alterations and further modifications of the described or illustrated embodiments and any further applications of the principles of the invention as illustrated therein are contemplated as would normally occur to one skilled in the art to which the invention relates.

One embodiment of this invention would be a painting protector made of rigid material, such as plastic or similar material in which paint does not easily adhere and/or in which paint can be easily removed without damaging the material. On one end would be a box, 1, with an open side, 2, and a closed side, 3. The closed side would be attached to a handle, 4, which is mounted onto the box and extends outward from the closed side, 3. The handle, 4, would include an offset, 5, to allow the user to comfortably hold the protector and easily keep it flush with the protected area. See FIGS. 1 and 2. Likewise a second box, 6, of another size, but similar in configuration, could be placed on the other end of the handle. The open end of the boxes would be available for placement over an area to be protected. The configuration of the box in use would be such that the protector could be placed in proximity of the area protected and prevent paint from entering the protected area. The size of the box, and all such boxes referenced herein, would be of the approximate size of an electrical outlet (either rectangular or circular) or light switch (including multiple switch configurations). In this way the protector could be placed over an outlet or switch and held temporarily in place while paint was applied around the area covered by the protector.

Figure 1:
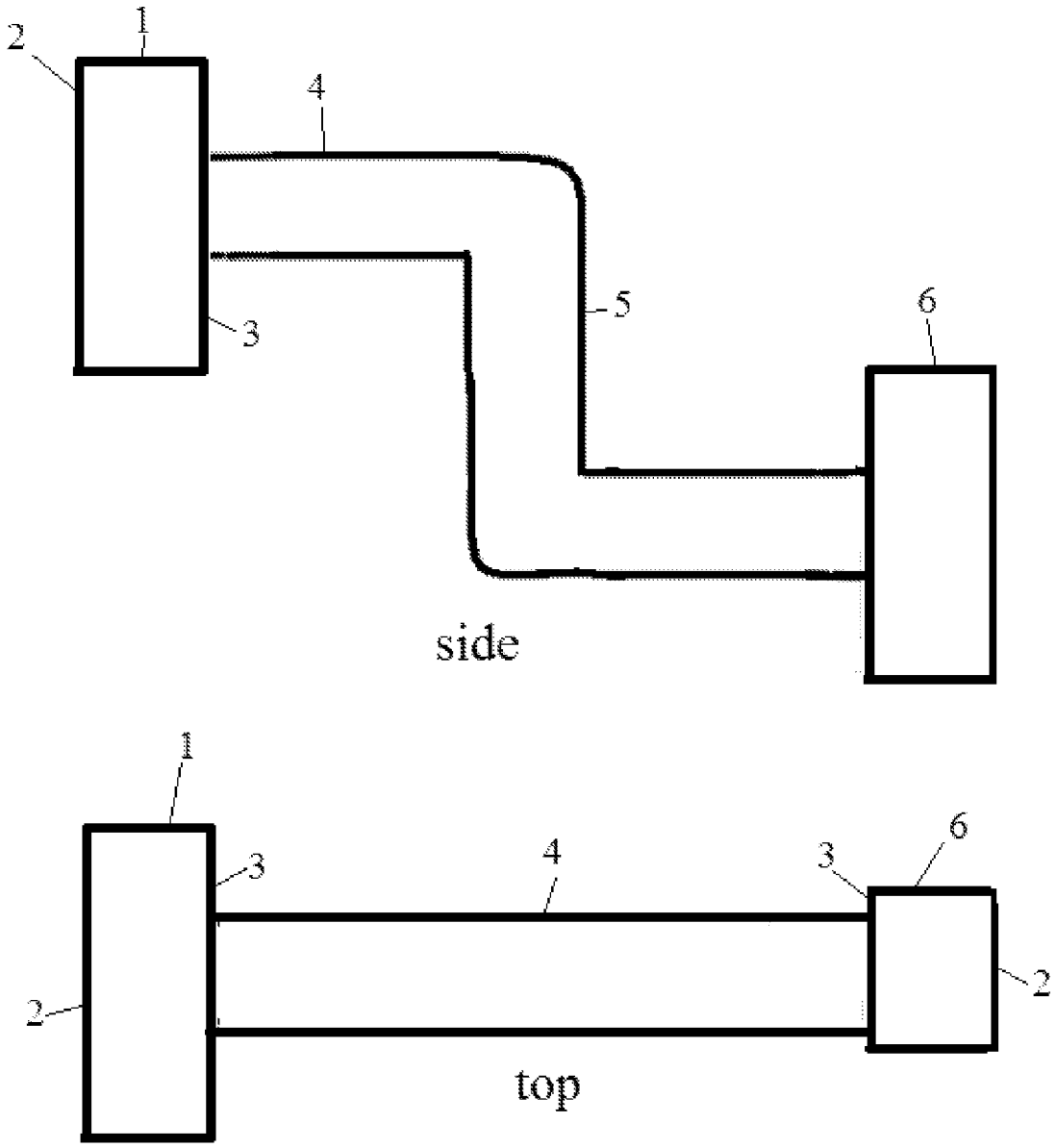
FIG. 1, shows a top and side view of one version of the painting protector.
Figure 2:
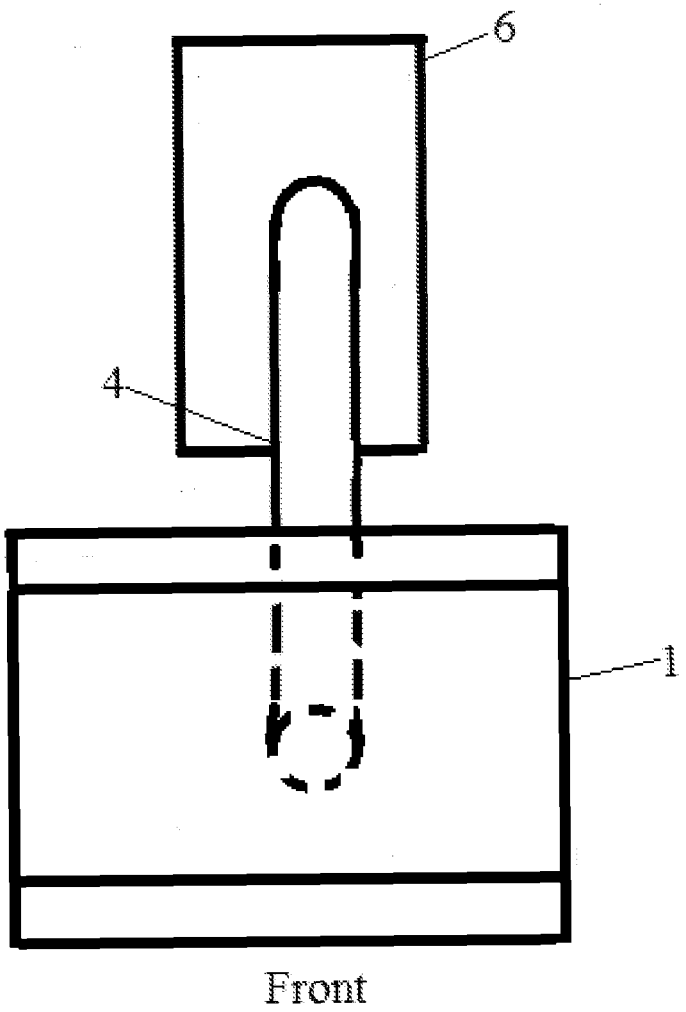
FIG. 2 shows a front view of one version of the painting protector.
Figure 3:
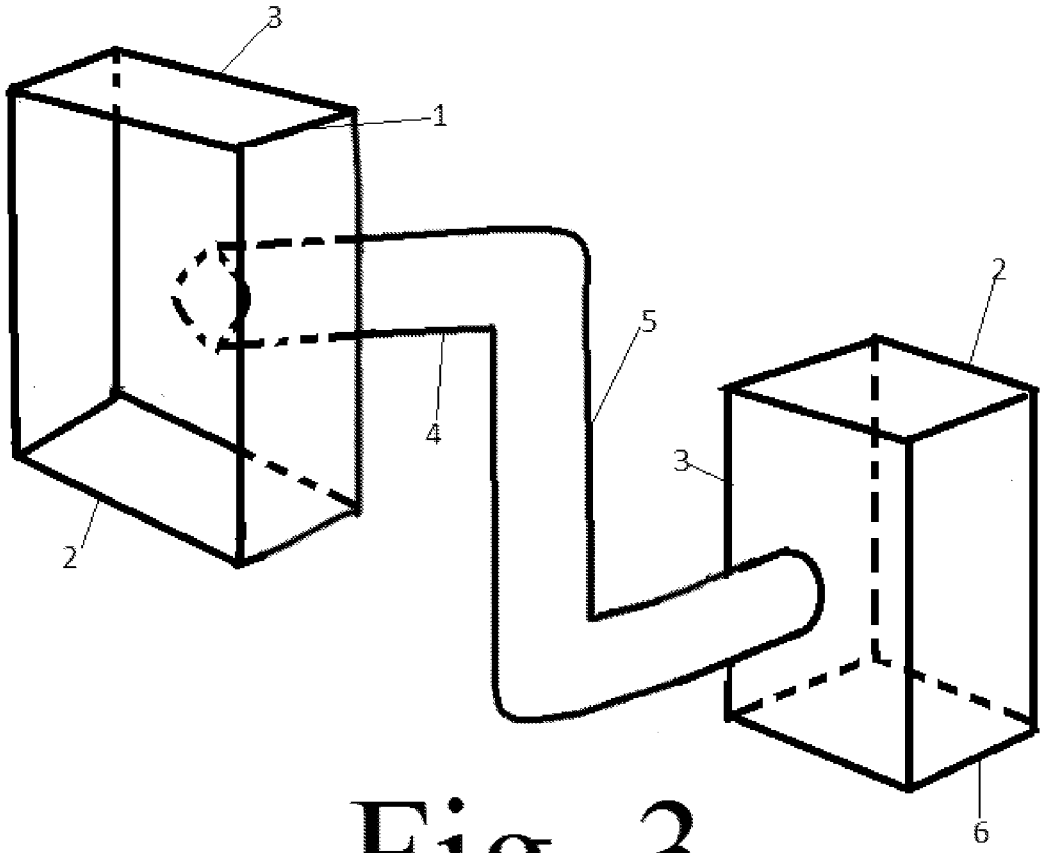
FIG. 3 is a three-dimensional view of the painting protector.

In the preferred embodiment the handle would have boxes mounted on both ends, see FIGS. 1, 2 and 3. The sizes of the boxes, 1 and 6, used in this configuration would be two most common sizes encountered by the users. In this embodiment, there is also the means for one or more boxes to be removed from the handle and other boxes put onto the handle. In this way, any combination of boxes can be combined with the handle.

Another embodiment involves the use of thinner material such that, while rigidity is maintained, the protector can be made cheaply enough that it could be considered disposable.

A further embodiment could involve the use of either a single box with handle or more than two boxes with a handle. In this way, you can either use a device which is singularly focused on one size of the protected area and in the other, you can address as many standard sizes of outlets/switches as may be available in the marketplace.

While the invention has been illustrated and described in detail with the foregoing description, the same is to be considered as illustrative and not restrictive in character, it being understood that only the preferred embodiment has been described and that all changes and modifications that come within the spirit of the invention are desired to be protected.

What is claimed is:

1. A paint masking tool for covering protected areas during painting comprising:

a) a first rectangular box made of a rigid material having a planar back wall of a first length and a first width and four planar sides extending from each of the edges of the back wall in the same direction, wherein a front side bounded by the four planar sides of the box opposite of the back wall is open;

b) a second rectangular box made of the rigid material having a planar back wall of a second length and a second width and four planar sides extending from each of the edges of the back wall in the same direction, wherein a front side bounded by the four planar sides of the box opposite of the back wall is open and wherein either the second length is different from the first length or the second width is different from the first width; and c) a handle having a first end and a second end, wherein the first end is connected to the first rectangular box and the second end is connected to the second rectangular box.

2. The paint masking tool of claim 1, wherein the first rectangular box is the same size as an electrical outlet or switch box.

3. The paint masking tool of claim 1, wherein the handle has a connection means to the first rectangular box which allows the first box to be removed so boxes of different sizes and configurations could then be placed onto the handle.

4. The paint masking tool of claim 3, wherein the handle has a connection means to the second rectangular box which allows the second box to be removed so boxes of different sizes and configurations could then be placed onto the handle.

5. The paint masking tool of claim 1, wherein the first end of the handle is connected to the back wall of the first rectangular box.

6. The paint masking tool of claim 1, wherein the second end of the handle is connected to the back wall of the second rectangular box.

7. The paint masking tool of claim 1, wherein the first end of the handle is connected to the back wall of the first rectangular box and the second end of the handle is connected to the back wall of the second rectangular box.

* * * * *